US007145534B2

(12) United States Patent
Ham

(10) Patent No.: US 7,145,534 B2
(45) Date of Patent: Dec. 5, 2006

(54) METHOD AND APPARATUS FOR DRIVING LIQUID CRYSTAL DISPLAY DERIVING MODULATED DATA USING APPROXIMATION

(75) Inventor: Yong Sung Ham, Kyounggi-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 739 days.

(21) Appl. No.: 09/991,956

(22) Filed: Nov. 26, 2001

(65) Prior Publication Data

US 2003/0048245 A1 Mar. 13, 2003

(30) Foreign Application Priority Data

Sep. 6, 2001 (KR) ..... 10-2001-54889

(51) Int. Cl.
*G09G 3/36* (2006.01)

(52) U.S. Cl. ..... 345/87; 345/89; 345/690

(58) Field of Classification Search ..... 345/87–103, 345/204–209, 609, 690–699
See application file for complete search history.

(56) References Cited

U.S. PATENT DOCUMENTS 5,229,762 A * 7/1993 Itoh et al. ..... 345/600
5,495,265 A 2/1996 Hartman et al.
5,798,740 A * 8/1998 Bitzakidis et al. ..... 345/92
6,452,579 B1 * 9/2002 Itoh et al. ..... 345/100
6,501,451 B1 * 12/2002 Sakashita ..... 345/87
6,700,559 B1 * 3/2004 Tanaka et al. ..... 345/88

FOREIGN PATENT DOCUMENTS

WO WO 99/05567 2/1999

* cited by examiner

*Primary Examiner*—Vijay Shankar
(74) *Attorney, Agent, or Firm*—McKenna Long & Aldridge LLP

(57) ABSTRACT

The present invention discloses a method and apparatus of driving a liquid crystal display device improving a picture quality. In the method and apparatus, modulated data bands including at least two modulated data centering a gray scale being approximate to a gray scale value of source data are derived. An approximation is carried out in two directions perpendicular to each other within the modulated data bands to derive unregistered modulated data positioned between the modulated data, thereby modulating the source data.

15 Claims, 13 Drawing Sheets

METHOD AND APPARATUS FOR DRIVING LIQUID CRYSTAL DISPLAY DERIVING MODULATED DATA USING APPROXIMATION

This application claims the benefit of Korean Application No. P2001-54889 filed on Sep. 6, 2001, which is hereby incorporated by reference.

BACKGROUND OF THE INVENTION

1. Field of the Invention

The present invention relates to a liquid crystal display, and more particularly, to a method and apparatus for a liquid crystal display. Although the present invention is suitable for a wide scope of applications, it is particularly suitable for improving a picture quality.

2. Discussion of the Related Art

Generally, a liquid crystal display (LCD) controls a light transmittance of each liquid crystal cell in accordance with a video signal, thereby displaying a picture. An active matrix LCD including a switching device for each liquid crystal cell is suitable for displaying a moving picture. The active matrix LCD uses a thin film transistor (TFT) as switching devices.

The LCD has a disadvantage in that it has a slow response time due to inherent characteristics of a liquid crystal, such as a viscosity and an elasticity, etc. Such characteristics can be explained by the following equations (1) and (2):

$$\tau_r \propto \gamma d^2/\Delta\epsilon|V_a^2-V_F^2| \quad (1)$$

where $\tau_r$ represents a rising time when a voltage is applied to a liquid crystal, $V_a$ is an applied voltage, $V_F$ represents a Freederick transition voltage at which liquid crystal molecules begin to perform an inclined motion, d is a cell gap of liquid crystal cells, and $\gamma$ represents a rotational viscosity of the liquid crystal molecules.

$$\tau_f \propto \gamma d^2/K \quad (2)$$

where $\tau_f$ represents a falling time at which a liquid crystal is returned into the initial position by an elastic restoring force after a voltage applied to the liquid crystal was turned off, and K is an elastic constant.

A twisted nematic (TN) mode liquid crystal has a response time altered due to physical characteristics of the liquid crystal and a cell gap, etc. Typically, the TN mode liquid crystal has a rising time of 20 to 80 ms and a falling time of 20 to 30 ms. Since such a liquid crystal has a response time longer than one frame interval (i.e., 16.67 ms in the case of NTSC system) of a moving picture, a voltage charged in the liquid crystal cell is progressed into the next frame prior to arriving at a target voltage. Thus, due to a motion-blurring phenomenon, a moving picture is blurred out on the screen.

Referring to FIG. 1, the conventional LCD cannot express desired color and brightness. Upon implementation of a moving picture, a display brightness BL fails to arrive at a target brightness corresponding to a change of the video data VD from one level to another level due to its slow response time. Accordingly, a motion-blurring phenomenon appears from the moving picture and a display quality is deteriorated in the LCD due to a reduction in a contrast ratio.

In order to overcome such a slow response time of the LCD, U.S. Pat. No. 5,495,265 and PCT International Publication No. WO99/05567 have suggested to modulate data in accordance with a difference in the data by using a look-up table (hereinafter referred to as high-speed driving strategy). This high-speed driving scheme allows data to be modulated by a principle as shown in FIG. 2.

Referring to FIG. 2, a conventional high-speed driving scheme modulates input data VD and applies the modulated data MVD to the liquid crystal cell, thereby obtaining a desired brightness MBL. This high-speed driving scheme increases $|V_a^2-V_F^2|$ from the above equation (1) on the basis of a difference of the data so that a desired brightness can be obtained in response to a brightness value of the input data within one frame interval, thereby rapidly reducing a response time of the liquid crystal. Accordingly, the LCD employing such a high-speed driving scheme compensates for a slow response time of the liquid crystal by modulating a data value in order to alleviate a motion-blurring phenomenon in a moving picture, thereby displaying a picture at desired color and brightness.

In other words, the high-speed driving scheme compares most significant bits of the previous frame Fn−1 with those of the current frame Fn to select corresponding modulated data Mdata from the look-up table if there is a change in the most significant bits MSB, as shown in FIG. 3. This high-speed driving scheme modulates only several most significant bits so as to reduce a capacity burden of a memory upon implementation of hardware equipment. A high-speed driving apparatus in this manner is as shown in FIG. 4.

Referring to FIG. 4, a conventional high-speed driving apparatus includes a frame memory 43 connected to the most significant bit bus line 42 and a look-up table 44 commonly connected to the most significant bit bus line 32 and an output terminal of the frame memory 43.

The frame memory 43 stores most significant bit data MSB during one frame interval and supplies the stored data to the look-up table 44. Herein, the most significant bit data MSB may be the most significant 4 bits of the 8-bit source data RGB.

The look-up table 44 compares most significant bits MSB of a current frame Fn inputted from the most significant bit line 42 with those of the previous frame Fn−1 inputted from the frame memory 43 as shown in Table 1 or Table 2, and selects the corresponding modulated data Mdata. The modulated data Mdata are added to least significant bits LSB from a least significant bit bus line 41 to be applied to the LCD.

TABLE 1

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | 0 | 2 | 3 | 4 | 5 | 6 | 7 | 9 | 10 | 12 | 13 | 14 | 15 | 15 | 15 | 15 |
| 1 | 0 | 1 | 3 | 4 | 5 | 6 | 7 | 8 | 10 | 12 | 13 | 14 | 15 | 15 | 15 | 15 |
| 2 | 0 | 0 | 2 | 4 | 5 | 6 | 7 | 8 | 10 | 12 | 13 | 14 | 15 | 15 | 15 | 15 |
| 3 | 0 | 0 | 1 | 3 | 5 | 6 | 7 | 8 | 10 | 11 | 13 | 14 | 15 | 15 | 15 | 15 |
| 4 | 0 | 0 | 1 | 2 | 4 | 6 | 7 | 8 | 9 | 11 | 12 | 13 | 14 | 15 | 15 | 15 |
| 5 | 0 | 0 | 1 | 2 | 3 | 5 | 7 | 8 | 9 | 11 | 12 | 13 | 14 | 15 | 15 | 15 |
| 6 | 0 | 0 | 1 | 2 | 3 | 4 | 6 | 8 | 9 | 10 | 12 | 13 | 14 | 15 | 15 | 15 |
| 7 | 0 | 0 | 1 | 2 | 3 | 4 | 5 | 7 | 9 | 10 | 11 | 13 | 14 | 15 | 15 | 15 |

TABLE 1-continued

| | | | | | | | | | | | | | | | | |
|---|---|---|---|---|---|---|---|---|---|---|---|---|---|---|---|---|
| 8 | 0 | 0 | 1 | 2 | 3 | 4 | 5 | 6 | 8 | 10 | 11 | 12 | 13 | 15 | 15 | 15 |
| 9 | 0 | 0 | 1 | 2 | 3 | 4 | 5 | 6 | 7 | 9 | 11 | 12 | 13 | 14 | 15 | 15 |
| 10 | 0 | 0 | 1 | 2 | 3 | 4 | 5 | 6 | 7 | 8 | 10 | 12 | 13 | 14 | 15 | 15 |
| 11 | 0 | 0 | 1 | 2 | 3 | 4 | 5 | 6 | 7 | 8 | 9 | 11 | 12 | 14 | 15 | 15 |
| 12 | 0 | 0 | 1 | 2 | 3 | 4 | 5 | 6 | 7 | 8 | 9 | 10 | 12 | 14 | 15 | 15 |
| 13 | 0 | 0 | 1 | 2 | 3 | 3 | 4 | 5 | 6 | 7 | 8 | 10 | 11 | 13 | 15 | 15 |
| 14 | 0 | 0 | 1 | 2 | 3 | 3 | 4 | 5 | 6 | 7 | 8 | 9 | 11 | 12 | 14 | 15 |
| 15 | 0 | 0 | 0 | 1 | 2 | 3 | 3 | 4 | 5 | 6 | 7 | 8 | 9 | 11 | 13 | 15 |

TABLE 2

| | 0 | 16 | 32 | 48 | 64 | 80 | 96 | 112 | 128 | 144 | 160 | 176 | 192 | 208 | 224 | 240 |
|---|---|---|---|---|---|---|---|---|---|---|---|---|---|---|---|---|
| 0 | 0 | 32 | 48 | 64 | 80 | 96 | 112 | 144 | 160 | 192 | 208 | 224 | 240 | 240 | 240 | 240 |
| 16 | 0 | 16 | 48 | 64 | 80 | 96 | 112 | 128 | 160 | 192 | 208 | 224 | 240 | 240 | 240 | 240 |
| 32 | 0 | 0 | 32 | 64 | 80 | 96 | 112 | 128 | 160 | 192 | 208 | 224 | 240 | 240 | 240 | 240 |
| 48 | 0 | 0 | 16 | 48 | 80 | 96 | 112 | 128 | 160 | 176 | 208 | 224 | 240 | 240 | 240 | 240 |
| 64 | 0 | 0 | 16 | 48 | 64 | 96 | 112 | 128 | 144 | 176 | 192 | 208 | 224 | 240 | 240 | 240 |
| 80 | 0 | 0 | 16 | 32 | 48 | 80 | 112 | 128 | 144 | 176 | 192 | 208 | 224 | 240 | 240 | 240 |
| 96 | 0 | 0 | 16 | 32 | 48 | 64 | 96 | 128 | 144 | 160 | 192 | 208 | 224 | 240 | 240 | 240 |
| 112 | 0 | 0 | 16 | 32 | 48 | 64 | 80 | 112 | 144 | 160 | 176 | 208 | 224 | 240 | 240 | 240 |
| 128 | 0 | 0 | 16 | 32 | 48 | 64 | 80 | 96 | 128 | 160 | 176 | 192 | 224 | 240 | 240 | 240 |
| 144 | 0 | 0 | 16 | 32 | 48 | 64 | 80 | 96 | 112 | 144 | 176 | 192 | 208 | 224 | 240 | 240 |
| 160 | 0 | 0 | 16 | 32 | 48 | 64 | 80 | 96 | 112 | 128 | 160 | 192 | 208 | 224 | 240 | 240 |
| 176 | 0 | 0 | 16 | 32 | 48 | 64 | 80 | 96 | 112 | 128 | 144 | 176 | 208 | 224 | 240 | 240 |
| 192 | 0 | 0 | 16 | 32 | 48 | 64 | 80 | 96 | 112 | 128 | 144 | 160 | 192 | 224 | 240 | 240 |
| 208 | 0 | 0 | 16 | 32 | 48 | 48 | 64 | 80 | 96 | 112 | 128 | 160 | 176 | 208 | 240 | 240 |
| 224 | 0 | 0 | 16 | 32 | 48 | 48 | 64 | 80 | 96 | 112 | 128 | 144 | 176 | 192 | 224 | 240 |
| 240 | 0 | 0 | 0 | 16 | 32 | 48 | 48 | 64 | 80 | 96 | 112 | 128 | 144 | 176 | 208 | 240 |

In the above tables, a furthermost left column is for a data voltage VDn−1 of the previous frame Fn−1 while an uppermost row is for a data voltage VDn of the current frame Fn. Table 1 is look-up table information in which the most significant bits (i.e., $2^0$, $2^1$, $2^2$ and $2^3$) are expressed by the decimal number format. Table 2 is look-up table information in which weighting values (i.e., $2^4$ $2^5$, $2^6$ and $2^7$) of the most significant 4 bits are applied to 8-bit data.

However, the conventional high-speed driving scheme has a problem in that, since it looks for the modulated data Mdata registered in the look-up table using the look-up table comparing only the most significant bits, a continuity of the modulated data Mdata is more deteriorated due to a deviation from a real gray scale of the video data. In addition, a data overshoot may be caused between the adjacent modulated data Mdata. For this reason, values of the modulated data Mdata at gray level portions indicated by arrows in FIG. 5 are jumped between a gray level of the real input data and a gray level of the modulated data Mdata, thereby causing a larger brightness variation. In order to solve this problem, it is necessary to enlarge a memory size of the frame memory and the look-up table to compare full bits (i.e., 8 bits) of source data, so that full-bit modulated data selected can be derived in accordance with the compared result. However, such a full-bit comparison raises another problem of enlarging a memory size of the frame memory and the look-up table. As a result, a cost required for a circuit configuration increases in the full bit data modulation. For instance, a look-up table comparing 8-bit source data to select 8-bit modulated data Mdata has a memory size of 65536×8=524 kbits.

SUMMARY OF THE INVENTION

Accordingly, the present invention is directed to a method and apparatus for driving a liquid crystal display that substantially obviates one or more of problems due to limitations and disadvantages of the related art.

Another object of the present invention is to provide a method and apparatus of driving a liquid crystal display that is adaptive for improving a picture quality.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method of driving a liquid crystal display includes setting at least two modulated data, deriving a plurality of modulated data bands including the at least two modulated data centering a gray scale that is approximate to a gray scale value of source data, and carrying out first and second approximations in two directions perpendicular to each other within the modulated data bands to derive unregistered modulated data positioned between the modulated data, thereby modulating the source data.

The method further includes dividing the source data into most significant bits and least significant bits, and delaying each of the most significant bits and the least significant bits for a frame period.

In the method, the driving the modulated data bands includes comparing the most significant bits of a current frame with those of the delayed frame within a look-up table registered with the modulated data to derive the modulated data bands in accordance with the compared result.

The carrying out first and second approximations includes carrying out the first approximation using current least significant bits along a horizontal axis within the modulated data bands to derive two first approximate values existing on the horizontal axis, and carrying out the second approximation using the previous least significant bits on a line between the two first approximate values to derive the unregistered modulated data.

Otherwise, the carrying out first and second includes carrying out the first approximation using previous least significant bits along a vertical axis within the modulated data bands to derive two first approximate values existing on the vertical axis, and carrying out the second approximation using current least significant bits on a line between the two first approximate values to derive the unregistered modulated data.

In another aspect of the present invention, a driving apparatus for a liquid crystal display includes a look-up table having at least two modulated data and deriving a plurality of modulated data bands including the at least two modulated data centering a gray scale that is approximate to a gray scale value of source data, and a modulator approximating in two directions perpendicular to each other within the modulated data bands to derive unregistered modulated data positioned between the modulated data, thereby modulating the source data.

The driving apparatus further includes a first frame memory delaying most significant bits of the source data, and a second frame memory delaying least significant bits of the source data.

In the driving apparatus, the delayed most significant bits are compared non-delayed most significant bits within a look-up table registered with the modulated data to derive the modulated data bands in accordance with the compared result.

The modulator includes a first approximation processor for carrying out a first approximation using current least significant bits along a horizontal axis within the modulated data bands to derive two first approximate values existing on the horizontal axis, and a second approximation processor carrying out a second approximation using previous least significant bits on a line between the two first approximate values to derive the unregistered modulated data.

Otherwise, the modulator includes a first approximation processor carrying out a first approximation using previous least significant bits along a vertical axis within the modulated data bands to derive two first approximate values existing on the vertical axis, and a second approximation processor carrying out a second approximation using current least significant bits on a line between the two first approximate values to derive the unregistered modulated data.

The driving apparatus further includes a data driver applying data modulated by using the modulator to the liquid crystal display, a gate driver applying a scanning signal to the liquid crystal display, and a timing controller applying the source data to the modulator and controlling the data driver and the gate driver.

In a further aspect of the present invention, a liquid crystal display includes a liquid crystal display panel displaying images, a look-up table having at least two registered modulated data and deriving a plurality of modulated data bands including the at least two modulated data centering a gray scale that is approximate to a gray scale value of source data, and a modulator approximating in two directions perpendicular to each other within the modulated data bands to derive unregistered modulated data positioned between the modulated data, thereby modulating the source data.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the same reference numbers will be used throughout the drawings to refer to the same or like parts.

Figure 1:
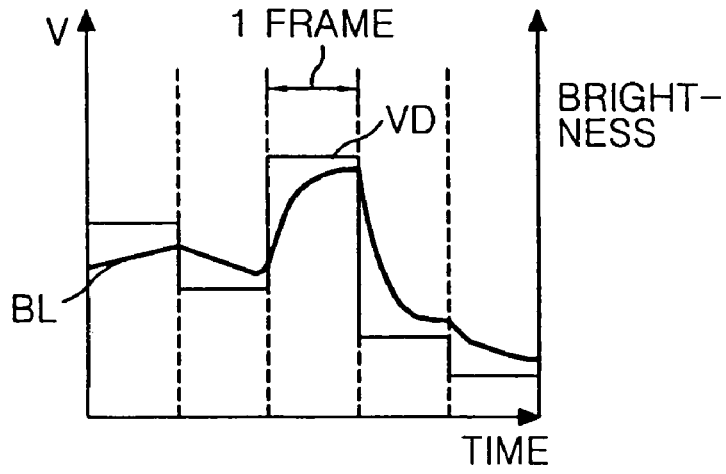
FIG. 1 CONVENTIONAL ART
FIG. 1 is a waveform diagram showing a brightness variation with respect to applied voltage data according to conventional liquid crystal display.
Figure 2:
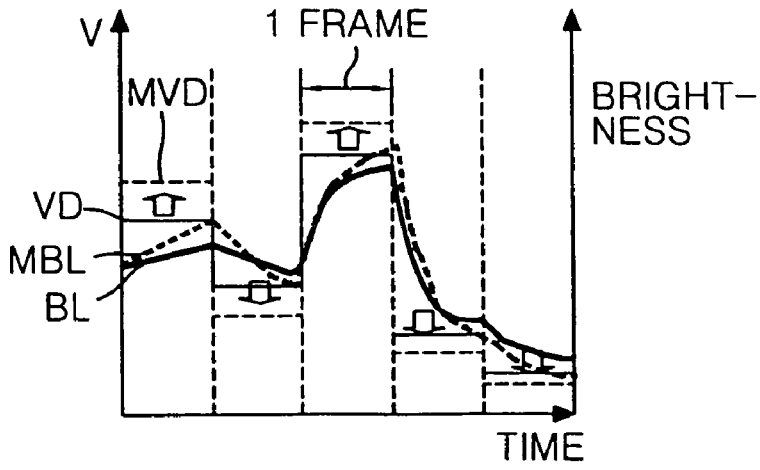
FIG. 2 CONVENTIONAL ART
FIG. 2 is a waveform diagram showing a brightness variation with respect to modulated voltage data according to a conventional high-speed driving scheme.
Figure 3:
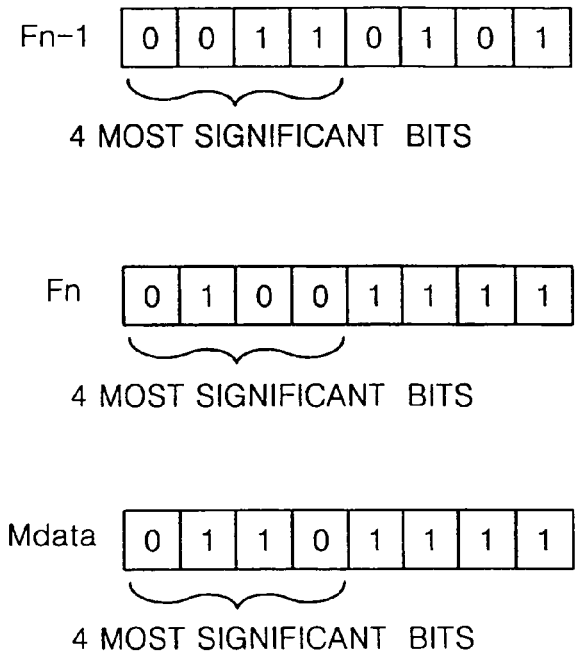
FIG.3 CONVENTIONAL ART
FIG. 3 illustrates the conventional high-speed driving scheme applied to 8-bit data.
Figure 4:
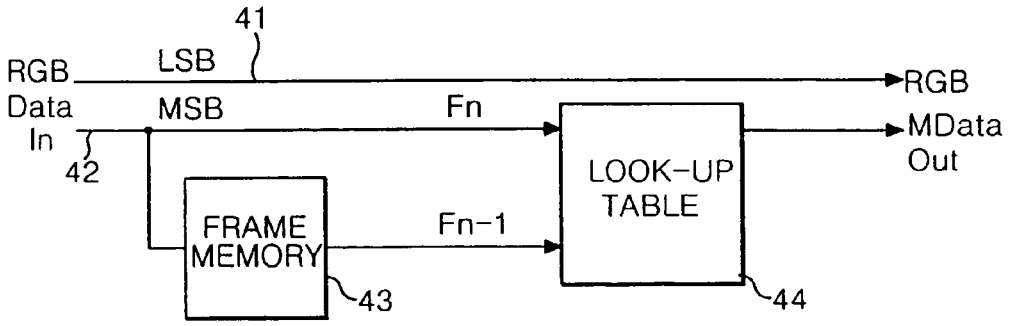
FIG.4 CONVENTIONAL ART
FIG. 4 is a block diagram showing a configuration of a conventional high-speed driving apparatus.
Figure 5:
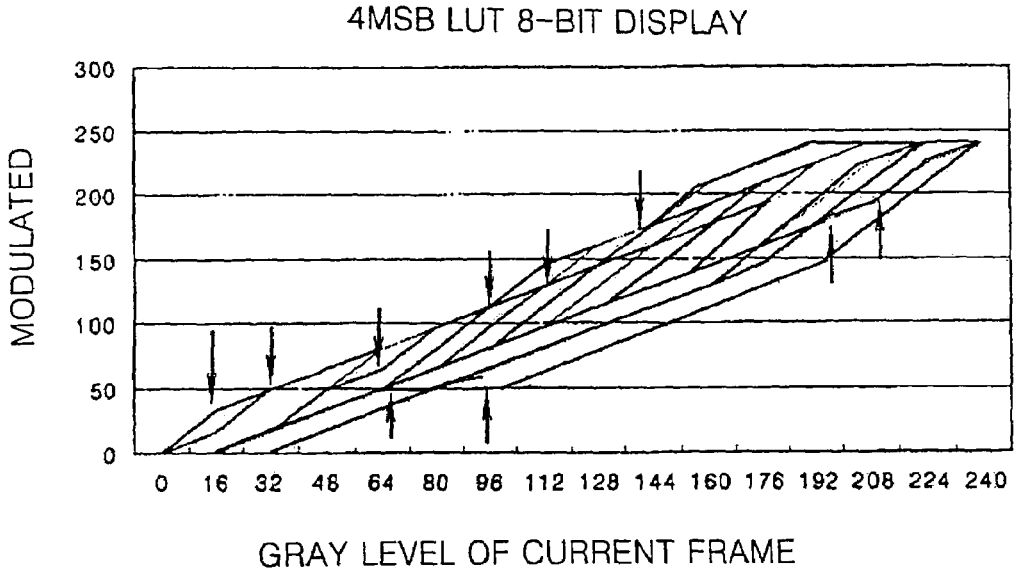
FIG. 5 CONVENTIONAL ART
FIG. 5 is a graph representing modulated data shown in Table 2.
Figure 6:
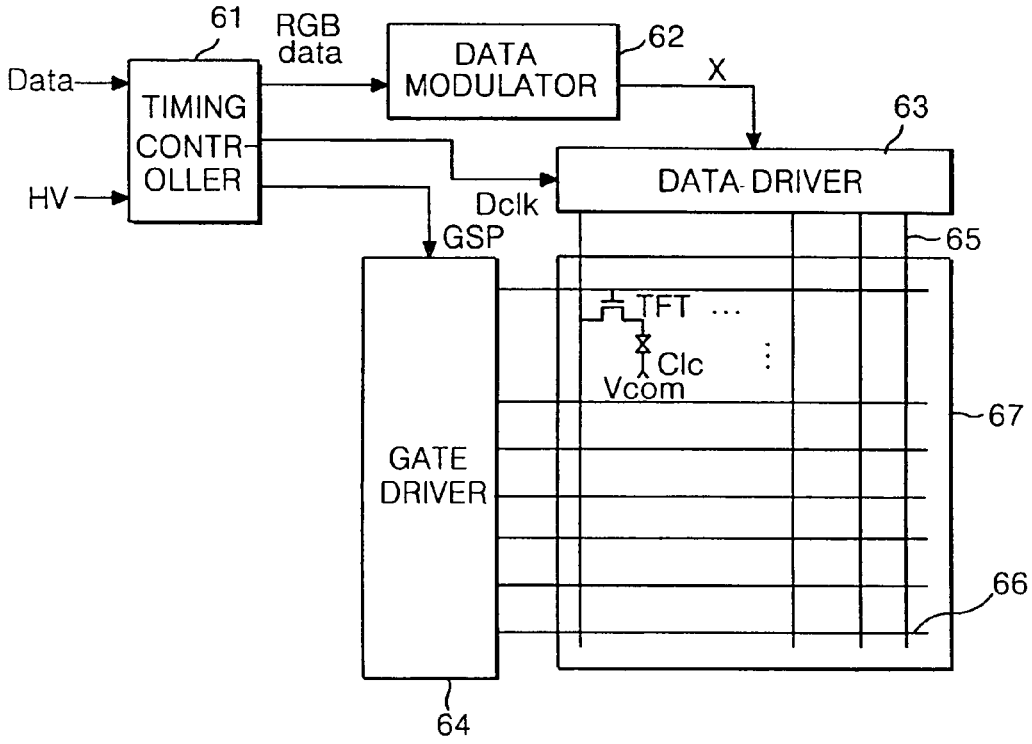
FIG. 6 is a block diagram showing a configuration of a driving apparatus for a liquid crystal display according to the present invention.

Referring to FIG. 6, a driving apparatus for a liquid crystal display (LCD) according to the present invention will be explained hereinafter.

The LCD driving apparatus includes a liquid crystal display panel 67 having a plurality of data lines 65 and gate lines 66 crossing each other and having TFTs provided at the intersections therebetween to drive liquid crystal cells Clc. A data driver 63 supplies data to the data lines 65 of the liquid crystal display panel 67. A gate driver 64 supplies a scanning pulse to the gate lines 66 of the liquid crystal display panel 67. A timing controller 61 receives digital video data and horizontal and vertical synchronizing signals H and V. A data modulator 62 is connected between the timing controller 61 and the data driver 63 to modulate data RGB using an approximation of the predetermined modulated data.

More specifically, the liquid crystal display panel 67 has a liquid crystal formed between two glass substrates and has the data lines 65 and the gate lines 66 provided on the lower glass substrate in such a manner to perpendicularly cross each other. The TFT provided at each intersection between the data lines 65 and the gate lines 66 responds to the scanning pulse and supplies the data through the data lines 65 to the liquid crystal cell Clc. To this end, a gate electrode of the TFT is connected to the gate lines 66 while a source electrode thereof is connected to the data lines 65. The drain electrode of the TFT is connected to a pixel electrode of the liquid crystal cell Clc.

The timing controller 61 rearranges digital video data supplied from a digital video card (not shown). The RGB data rearranged by the timing controller 61 are supplied to the data modulator 62. Further, the timing controller 61 generates timing signals, such as a dot clock Dclk, a gate start pulse GSP, a gate shift clock GSC (not shown), an output enable/disable signal, and a polarity control signal using horizontal and vertical synchronizing signals H and V to control the data driver 63 and the gate driver 64. The dot clock Dclk and the polarity control signal are applied to the data driver 63, while the gate start pulse GSP and the gate shift clock GSC are applied to the gate driver 64.

The gate driver 64 includes a shift register sequentially generating a scanning pulse, that is, a gate high pulse, in response to the gate start pulse GSP and the gate shift clock GSC applied from the timing controller 61, and a level shifter shifting a voltage of the scanning pulse into a level suitable for driving the liquid crystal cell Clc. The TFT is turned on in response to the scanning pulse. Upon turning on the TFT, video data on the data lines 65 are applied to the pixel electrode of the liquid crystal cell Clc.

The data driver 63 is supplied with red (R), green (G), and blue (B) modulated data X modulated by the data modulator 62 and receives a dot clock Dclk from the timing controller 61. The data driver 63 samples the R, G, and B modulated data X in accordance with the dot clock Dclk and thereafter latches the modulated data for each line. The data latched by the data driver 63 are converted into analog data to be simultaneously applied to the data lines 65 at every scanning interval. Further, the data driver 63 may apply a gamma voltage corresponding to the modulated data to the data lines 65.

The data modulator 62 modulates current input data RGB using a look-up table in accordance with a change between the previous frame Fn−1 and the current frame Fn. Further, the data modulator 62 derives a minute modulation value of the modulated data registered in the look-up table using an approximation to better modulate current input data RGB. Herein, a data width of the look-up table may equalize to that of the most significant bits MSB. However, it is preferable that it equalizes to a data width (i.e., 8 bits) of the source data RGB.

Figure 7:
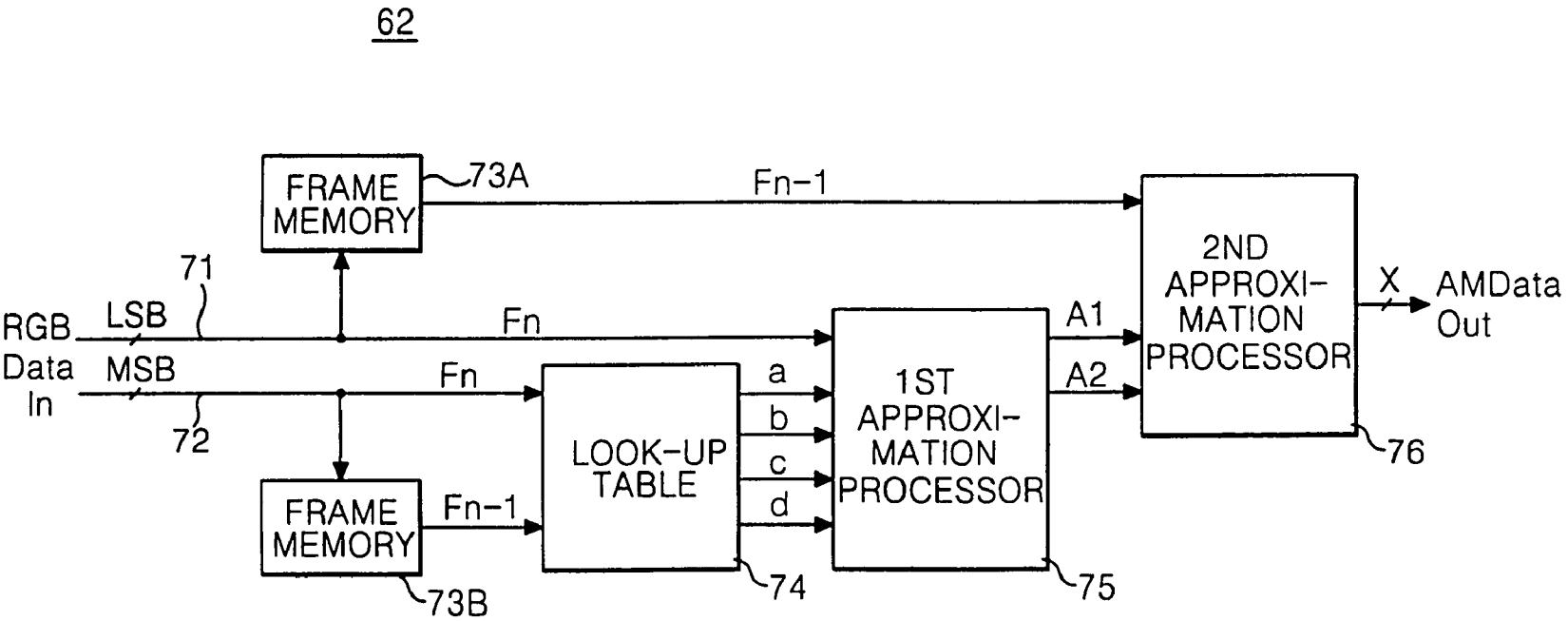
FIG. 7 is a detailed block diagram of the data modulator shown in FIG. 6 according to a first embodiment of the present invention.

FIG. 7 shows a detailed block diagram of the data modulator 62 according to a first embodiment of the present invention.

Referring to FIG. 7, the data modulator 62 includes a first frame memory 73A supplied with least significant bits LSB. A second frame memory 73B is supplied with most significant bits MSB. A look-up table 74 compares the most significant bits MSB of the current frame Fn with those of the previous frame Fn−1 to derive a desired size of the modulated data band. A first approximation processor 75 carries out a first approximation on the X-axis (i.e., horizontal axis) within the modulated data band. A second approximation processor 76 carries out a second approximation on the Y-axis (i.e., vertical axis) between the first approximated values.

More specifically, the first frame memory 73A is connected to a least significant bit bus line 71 of the timing controller 61 (shown in FIG. 6) to store the least significant bits LSB inputted from the timing controller 61 during one frame interval. The first frame memory 73A applies the least significant bit data LSB stored every frame to the second approximation processor 76.

The second frame memory 73B is connected to a most significant bit bus line 72 of the timing controller 61 to store the most significant bits MSB inputted from the timing controller 61 during one frame interval. The second frame memory 73B applies the most significant bits MSB stored into the look-up table 74 at every frame.

The look-up table 74 compares the most significant bits MSB of the current frame Fn inputted from the most significant bit bus line 72 of the timing controller 61 with those of the previous frame Fn−1 inputted from the frame memory 73. In accordance with the compared result, the look-up table 74 selects a desired data size of modulated data band Band(a, b, c, d) from the modulated data a, b, c, and d satisfying the following equations:

$$VDn<VDn-1 \text{---}> MVDn < VDn \quad \text{(i)}$$

$$VDn=VDn-1 \text{---}> MVDn = VDn \quad \text{(ii)}$$

$$VDn>VDn-1 \text{---}> MVDn > VDn \quad \text{(iii)}$$

In the above equations, VDn−1 represents a data voltage of the previous frame, VDn is a data voltage of the current frame, and MVDn represents a modulated data voltage.

When source data inputted to the data modulator 62 is 8 bits and the most significant bits inputted to the look-up table 74 are 4 bits, modulated data registered in the look-up table 74 are given in the following table:

TABLE 3

| | 0 | 16 | 32 | 48 | 64 | 80 | 96 | 112 | 128 | 144 | 160 | 176 | 192 | 208 | 224 | 240 | 255 |
|---|---|---|---|---|---|---|---|---|---|---|---|---|---|---|---|---|---|
| 0 | 0 | 20 | 44 | 58 | 90 | 120 | 150 | 180 | 200 | 228 | 234 | 243 | 253 | 255 | 255 | 255 | 255 |
| 16 | 0 | 16 | 36 | 55 | 75 | 103 | 130 | 148 | 170 | 204 | 218 | 239 | 245 | 255 | 255 | 255 | 255 |
| 32 | 0 | 13 | 32 | 52 | 70 | 98 | 116 | 143 | 167 | 191 | 212 | 230 | 242 | 255 | 255 | 255 | 255 |
| 48 | 0 | 11 | 28 | 48 | 68 | 90 | 111 | 133 | 159 | 180 | 207 | 227 | 240 | 247 | 255 | 255 | 255 |
| 64 | 0 | 9 | 26 | 42 | 64 | 86 | 106 | 129 | 157 | 177 | 196 | 225 | 239 | 246 | 255 | 255 | 255 |
| 80 | 0 | 9 | 23 | 39 | 55 | 80 | 101 | 127 | 148 | 170 | 192 | 223 | 237 | 245 | 255 | 255 | 255 |
| 96 | 0 | 8 | 21 | 37 | 53 | 74 | 96 | 118 | 138 | 164 | 186 | 212 | 236 | 244 | 255 | 255 | 255 |

TABLE 3-continued

| | | | | | | | | | | | | | | | | | |
|---|---|---|---|---|---|---|---|---|---|---|---|---|---|---|---|---|---|
| 112 | 0 | 7 | 20 | 36 | 52 | 70 | 87 | 112 | 132 | 155 | 180 | 199 | 228 | 243 | 255 | 255 | 255 |
| 128 | 0 | 7 | 18 | 35 | 50 | 68 | 85 | 103 | 128 | 150 | 175 | 194 | 223 | 242 | 255 | 255 | 255 |
| 144 | 0 | 7 | 18 | 33 | 48 | 64 | 82 | 100 | 120 | 144 | 170 | 191 | 221 | 242 | 255 | 255 | 255 |
| 160 | 0 | 6 | 17 | 31 | 44 | 61 | 79 | 96 | 115 | 135 | 160 | 183 | 216 | 241 | 255 | 255 | 255 |
| 176 | 0 | 6 | 16 | 27 | 41 | 57 | 72 | 91 | 111 | 130 | 151 | 176 | 110 | 231 | 244 | 255 | 255 |
| 192 | 0 | 5 | 15 | 26 | 39 | 52 | 70 | 88 | 103 | 120 | 143 | 166 | 191 | 220 | 238 | 255 | 255 |
| 208 | 0 | 5 | 12 | 23 | 36 | 47 | 63 | 79 | 95 | 114 | 135 | 159 | 180 | 208 | 232 | 250 | 255 |
| 224 | 0 | 4 | 10 | 21 | 31 | 42 | 54 | 68 | 87 | 104 | 124 | 146 | 169 | 194 | 224 | 247 | 255 |
| 240 | 0 | 0 | 7 | 18 | 28 | 36 | 47 | 58 | 71 | 90 | 103 | 124 | 146 | 175 | 202 | 240 | 255 |
| 255 | 0 | 0 | 5 | 8 | 18 | 26 | 31 | 40 | 53 | 70 | 87 | 106 | 122 | 138 | 167 | 207 | 255 |

As shown in Table 3, the look-up table 74 compares a gray level of the source data RGB at 17×17 and selects 8-bit modulated data set to satisfy the above equations (i) to (iii) in accordance with the compared result. Since a memory size of the look-up table 74 is 289×8=2,312 bits, it is smaller than those (i.e., 524 kbits) of the look-up table employing an 8-bit comparison/8-bit modulation data system. Herein, 289 is a value obtained by multiplying most significant bits of 17 gray levels of the current frame Fn by those of the previous frame Fn−1 of the source data inputted to the look-up table 74.

Gray scale ranges of the source data RGB unregistered in the look-up data, such as gray scale data of 1~15, 17~31, 33~47, 49~63, 65~78, 81~95, 97~111, 113~127, 129~143, 145~159, 161~175, 177~191, 193~207, 209~223, 225~239, and 241~254, are derived by registering modulated data within the look-up table 74 and carrying out an approximation between the most adjacent two gray scales. In comparison to this scheme, the conventional scheme determines a gray scale range unregistered in the look-up table 74 on the basis of the least significant bits LSB added to the modulated data selected from the look-up table 74. The modulated data band to be approximated according to a preferred embodiment of the present invention is a data area between a range of gray level values in the horizontal direction and a range of gray level values in the vertical direction with respect to the look-up table 74 (shown as the data area within the dashed lines in FIG. 9) adjacent to the registered modulated data that are the most approximate to gray level values of the source data RGB.

The first approximation processor 75 carries out the first approximation along the X-axis using the least significant bits LSB of the current frame Fn within the modulated data band from the look-up table 74 to derive two first approximate values A1 and A2.

The second approximation processor 76 carries out the second approximation along the Y-axis between the first approximate values A1 and A2 using the least significant bits LSB of the previous frame Fn−1 to derive modulated data X.

Detailed descriptions for the first and second approximation processes are explained with reference to FIG. 8.

Figure 8:
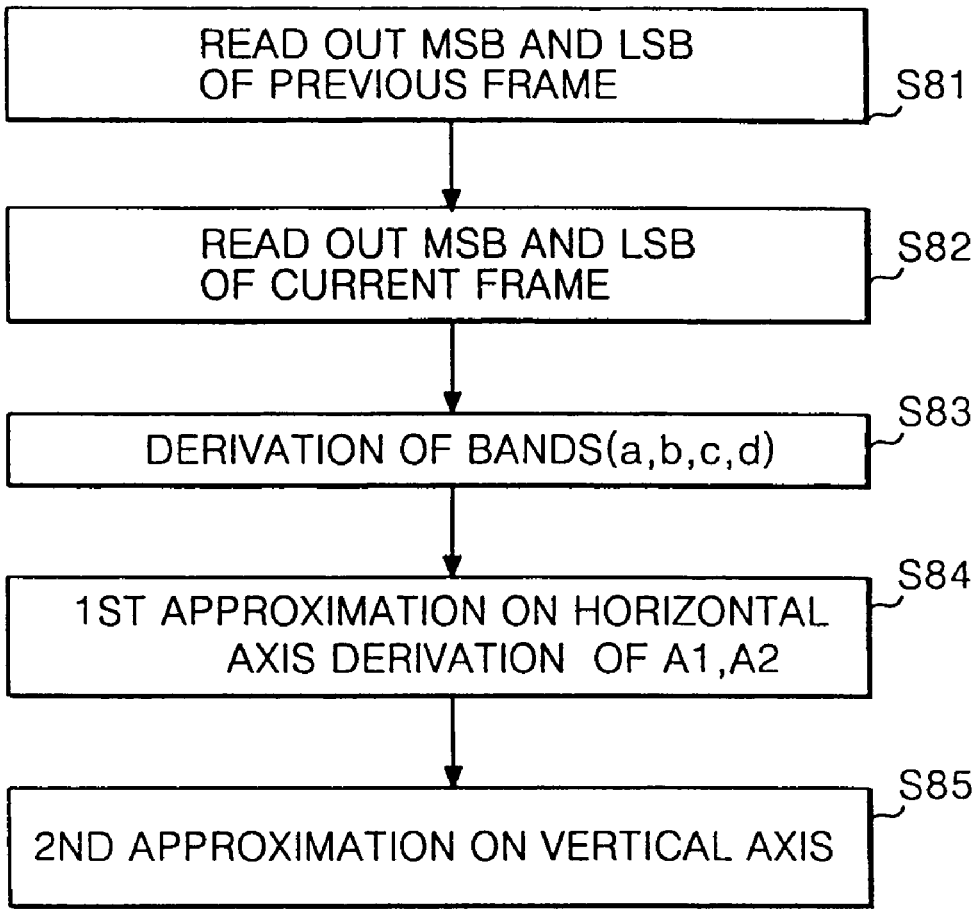
FIG. 8 is a flow chart illustrating a method of driving a liquid crystal display according to the first embodiment of the present invention.
Figure 9:
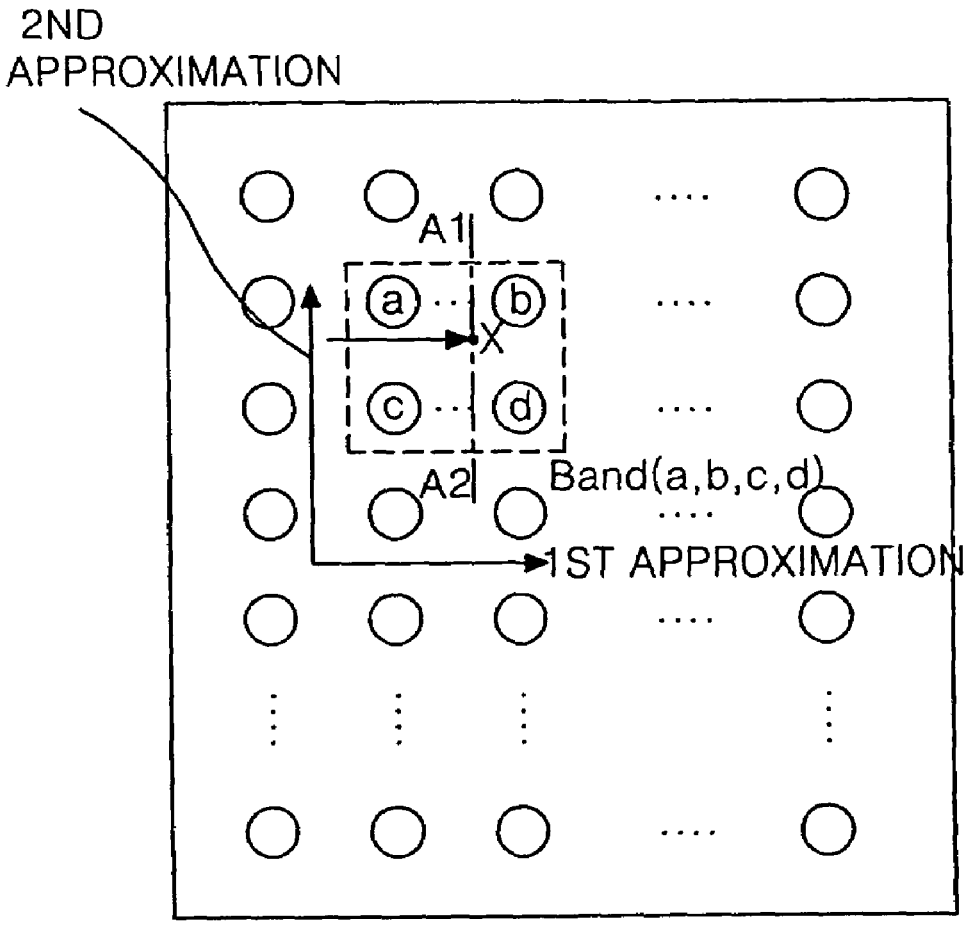
FIG. 9 illustrates an approximation process for a liquid crystal display according to the first embodiment of the present invention.

Referring to FIG. 8, in step S81, the most significant bits MSB and the least significant bits LSB of the previous frame Fn−1 delayed by the first and second frame memories 73A and 73B, respectively, are read out. In step S82, the most significant bits MSB and the least significant bits LSB of the current frame Fn are read out. In step S83, modulated data band Band(a, b, c, d) corresponding to the source data RGB within the look-up table 74 is derived in accordance with the most significant bits MSB of the current frame Fn and those of the previous frame Fn−1 read out in this manner. The modulated data band Band(a, b, c, d) is are data ranges between four modulated data a, b, c, and d that is most approximate to a modulated data value corresponding to the most significant bits MSB inputted to the look-up table 74 as shown in FIG. 9.

In step S84, the first approximation processor 75 carries out the first approximation using values of the least significant bits LSB of the current frame Fn within the modulated data band Band(a, b, c, d) to derive two first approximate values A1 and A2 that are vertically opposite to each other within the modulated data band Band(a, b, c, d). The first approximation is carried out along the X-axis within the modulated data band Band(a, b, c, d) with respect to the look-up table 74 as shown in FIG. 9.

In step S85, the second approximation processor 76 carries out a secondary approximation using values of the least significant bits LSB of the previous frame Fn−1 within the modulated data band Band(a, b, c, d) to derive the modulated data X at the vertical line between the two first approximate values A1 and A2. The secondary approximation is carried out along the Y-axis within the modulated data band Band(a, b, c, d) with respect to the look-up table 74 as shown in FIG. 9.

Figure 10:
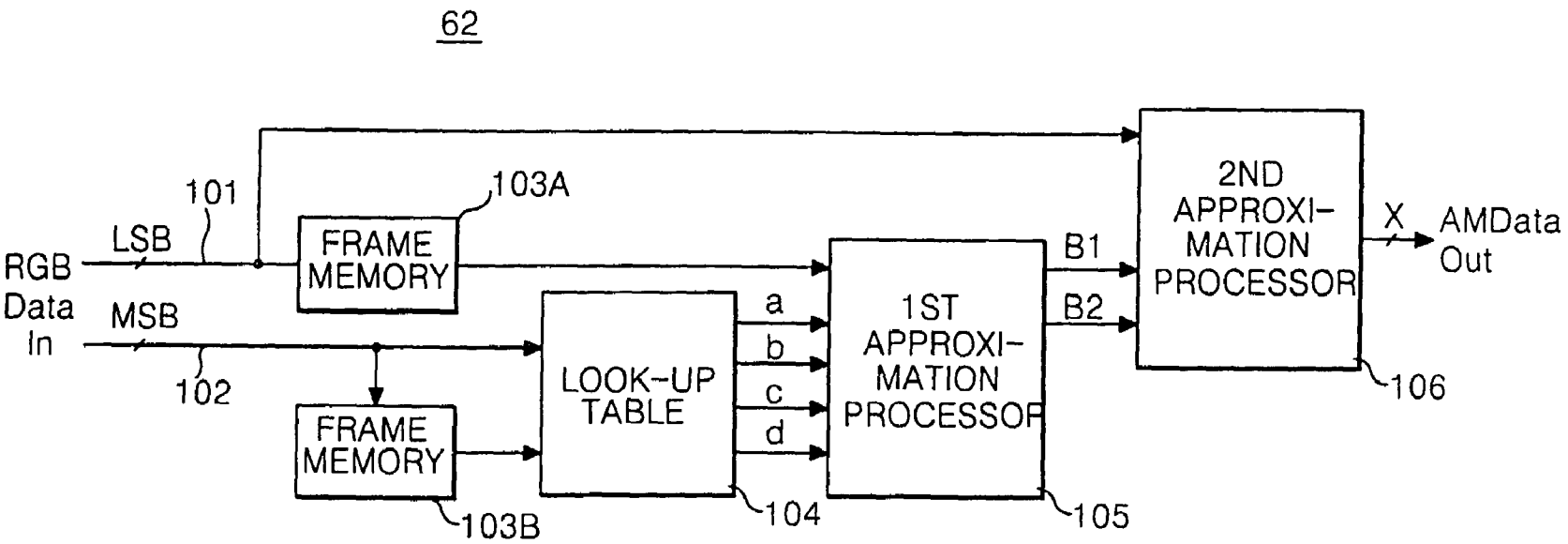
FIG. 10 is a detailed block diagram of the data modulator shown in FIG. 6 according to a second embodiment of the present invention.

FIG. 10 shows a detailed block diagram of the data modulator 62 according to a second embodiment of the present invention.

Referring to FIG. 10, the data modulator 62 includes a first frame memory 103A receiving least significant bits LSB and a second frame memory 103B supplied with most significant bits MSB. A look-up table 104 comparing the most significant bits MSB of the previous frame Fn with those of the current frame Fn−1 to derive a desired size of modulated data band. A first approximation processor 105 carries out a first approximation on the Y-axis (i.e., vertical axis) within the modulated data band and a second approximation processor 76 carries out a second approximation on the Y-axis (i.e., vertical axis) between the first approximate values.

More specifically, the first frame memory 103A is connected to a least significant bit bus line 101 of the timing controller 61 to store the least significant bits LSB inputted from the timing controller 61 during one frame interval. Further, the first frame memory 103A applies the least significant bit data LSB stored every frame to the first approximation processor 105.

The second frame memory 103B is connected to a most significant bit bus line 102 of the timing controller 61 to store the most significant bits MSB inputted from the timing controller 61 during one frame interval. Further, the second frame memory 103B applies the most significant bits MSB stored every frame to the look-up table 104.

The look-up table 104 compares the most significant bits MSB of the current frame Fn inputted from the most significant bit bus line 102 of the timing controller 61 with those of the previous frame Fn−1 inputted from the frame memory 103. In accordance with the compared result, the look-up table 104 derives modulated data bands a, b, c, and d from the modulated data as given in Table 3 to satisfy the above equations (i) to (iii). The modulated data bands a, b, c, and d derived by using the look-up table 104 are applied to the first approximation processor 105. The modulated data registered in the look-up table 104 are given in Table 3.

In Table 3, gray scale data of the source data RGB unregistered in the look-up table 104 have modulated values determined by an approximation carried out within the modulated data bands a, b, c, and d.

The first approximation processor 105 carries out the approximation along the Y-axis using the least significant bits LSB of the previous frame Fn−1 within the modulated data bands from the look-up table 74 to derive two first approximate values B1 and B2.

The second approximation processor 106 carries out a second approximation along the X-axis between the primary approximate values B1 and B2 using the least significant bits LSB of the current frame Fn to derive modulated data X.

Figure 11:
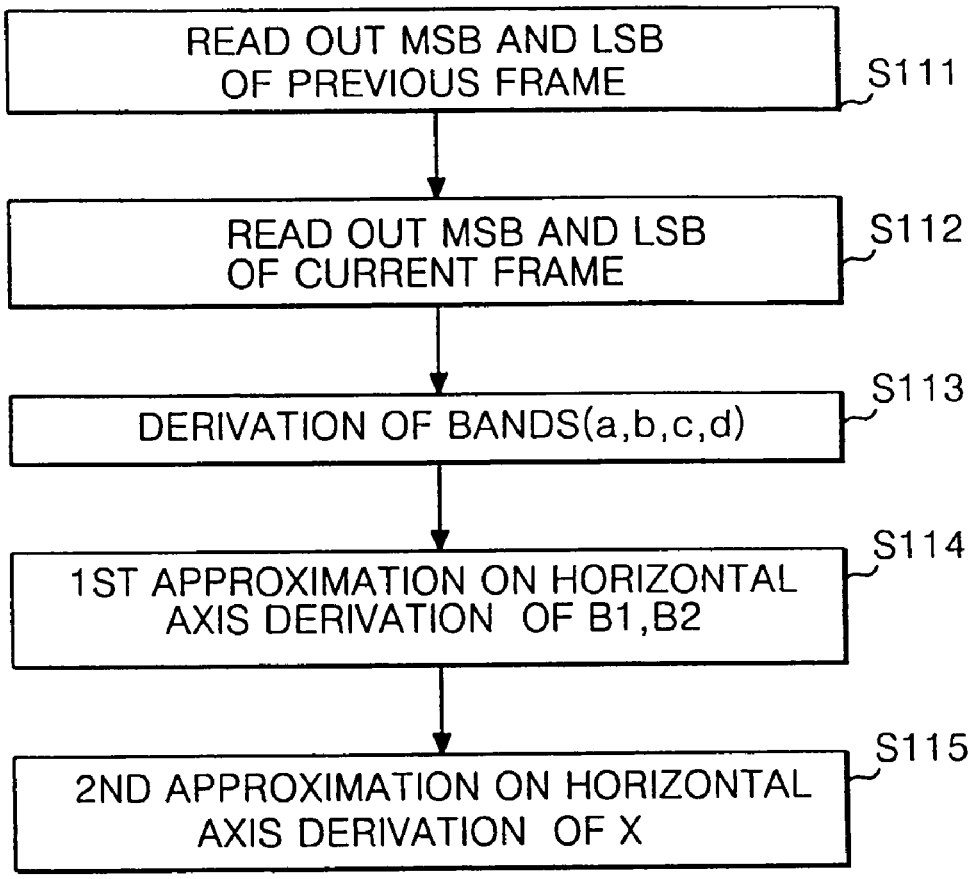
FIG. 11 is a flow chart illustrating a method of driving a liquid crystal display according to the second embodiment of the present invention.

FIG. 11 shows an approximation process carried out by using the data modulator 62 according to the second embodiment of the present invention.

Figure 12:
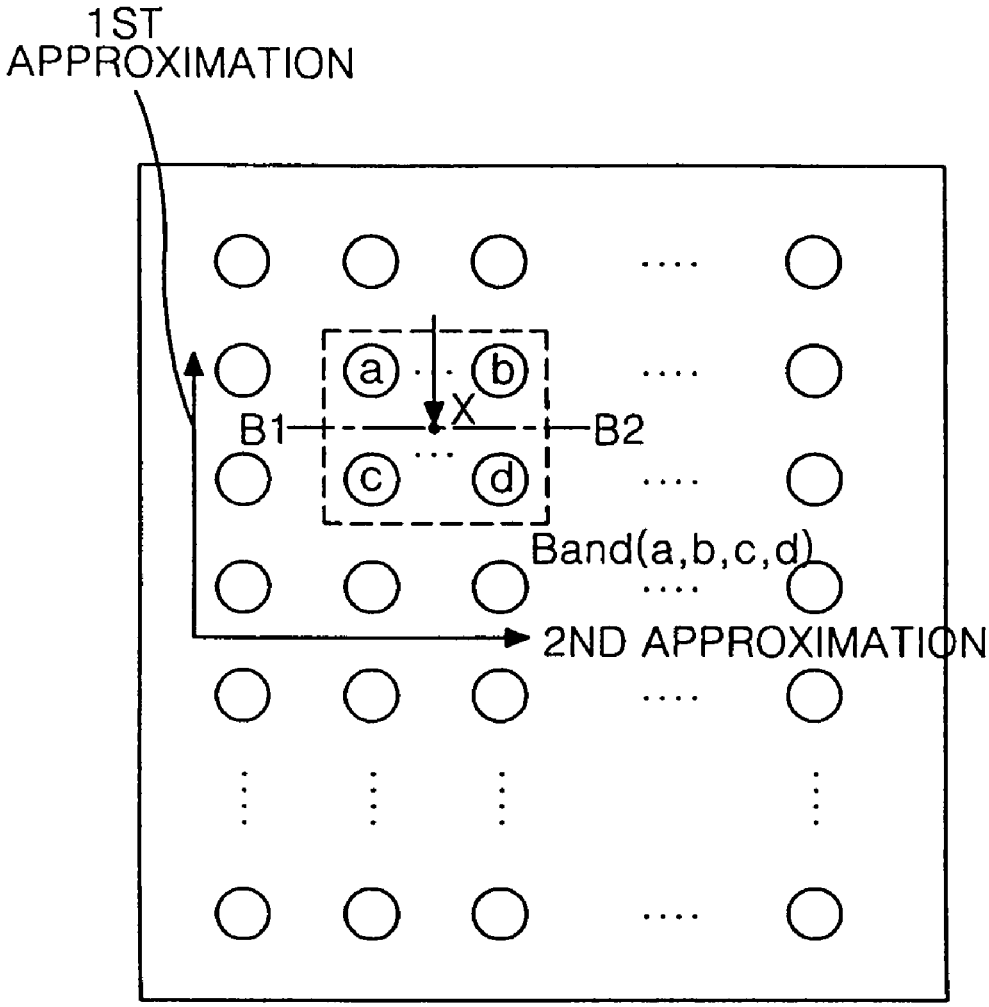
FIG. 12 illustrates an approximation process for a liquid crystal display according to the second embodiment of the present invention.

Referring to FIG. 11, in step S111, the most significant bits MSB and the least significant bits LSB of the previous frame Fn−1 delayed by the first and second frame memories 103A and 103B, respectively, are read out. The most significant bits MSB and the least significant bits LSB of the current frame Fn are read out in step S112. In step S113, modulated data band Band(a, b, c, d) corresponding to the source data RGB within the look-up table 104 is derived in accordance with the most significant bits MSB of the current frame Fn and the previous frame Fn−1 read out in this manner. The modulated data band Band(a, b, c, d) is data ranges between four modulated data a, b, c, and d that is most approximate to modulated data values corresponding to the most significant bits MSB inputted to the look-up table 104 as source data as shown in FIG. 12.

In step S114, the first approximation processor 105 carries out the first approximation using values of the least significant bits LSB of the previous frame Fn−1 within the modulated data band Band(a, b, c, d) to derive two first approximate values B1 and B2 that are horizontally opposite to each other within the modulated data band Band(a, b, c, d). The first approximation is carried out along the Y-axis within the modulated data band Band(a, b, c, d), with respect to the look-up table 104 as shown in FIG. 12.

In step S115, the second approximation processor 106 carries out the second approximation using values of the least significant bits LSB of the current frame Fn within the modulated data band Band(a, b, c, d) undergoing an approximation to derive modulated data X on the horizontal line between the two first approximate values B1 and B2. This second approximation is carried out along the X-axis within the modulated data band Band(a, b, c, d) with respect to the look-up table 104 undergoing an approximation, as shown in FIG. 12.

Figure 13:
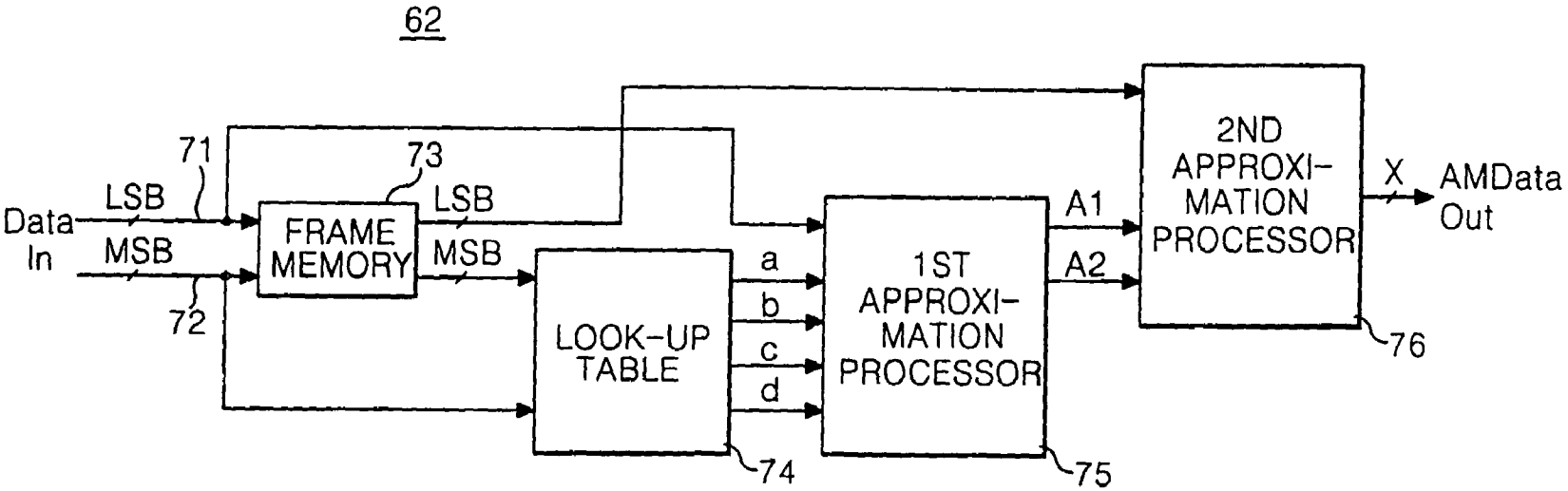
FIG. 13 is a detailed block diagram of the data modulator shown in FIG. 6 according to a third embodiment of the present invention.
Figure 14:
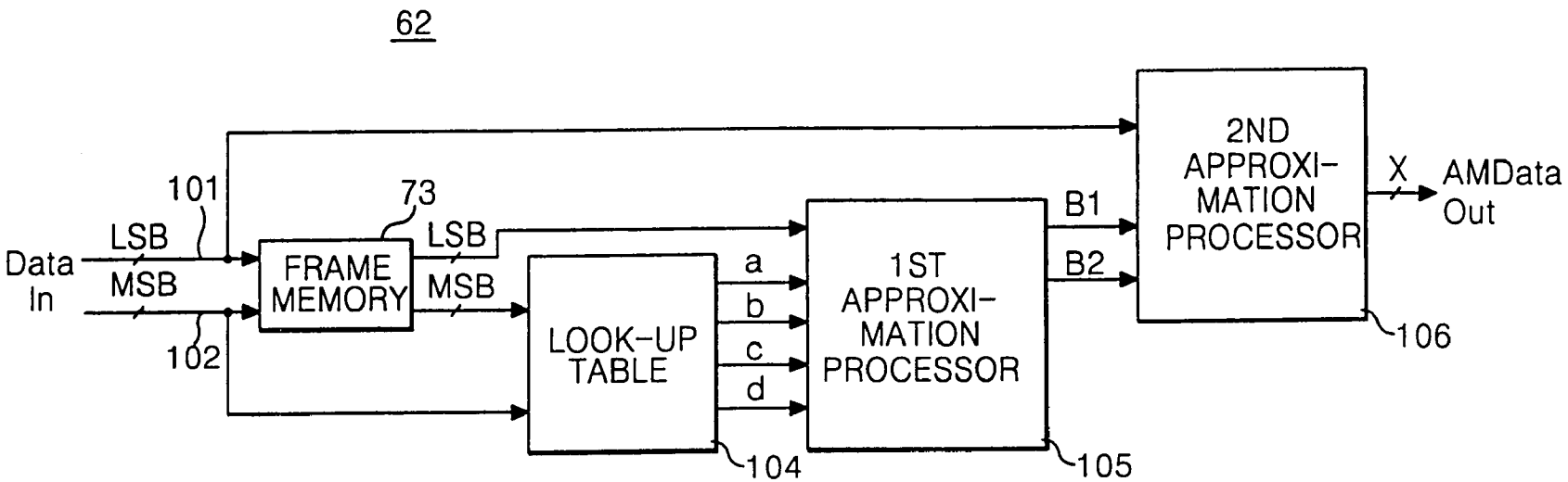
FIG. 14 is a detailed block diagram of the data modulator shown in FIG. 6 according to a fourth embodiment of the present invention.
Figure 15:
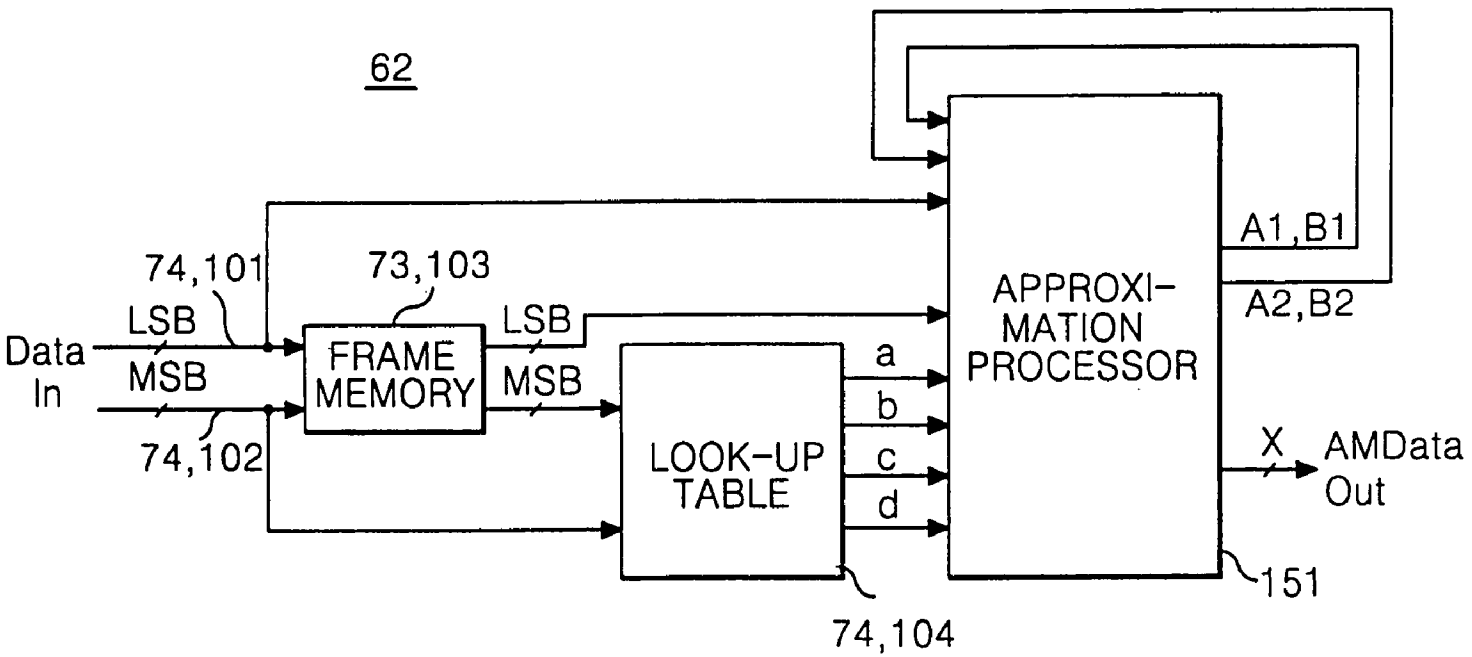
FIG. 15 is a detailed block diagram of the data modulator shown in FIG. 6 according to a fifth embodiment of the present invention.

In the mean time, the two frame memories 73A and 73B and the frame memories 103A and 103B shown in FIG. 7 and FIG. 10, respectively, may be incorporated into a single unit. For example, FIG. 13 illustrates the data modulator 62 (shown in FIG. 6) in which the frame memories 73A and 73B shown in FIG. 7 may be incorporated into a single frame memory 73. FIG. 14 illustrates the data modulator 62 in which the frame memories 103A and 103B shown in FIG. 10 may be incorporated into a single frame memory 103. Alternatively, the two approximation processors 75 and 76 or the two approximation processors 105 and 106 carrying out the first and second approximations may be incorporated into a single unit as shown in FIG. 15.

As described above, according to the present invention, a desired size of the modulated data bands is established to carry out approximations within the modulated data bands, thereby selecting the modulated data. Accordingly, the modulated data selected by the approximations are linearly increased and decreased, so that a discontinuity between the modulated data can be eliminated to improve a picture quality. Furthermore, according to the present invention, modulated data unregistered in the look-up table are derived by approximations, so that a memory size of the look-up table is reduced.

The data modulator may be implemented by other means, such as a program and a microprocessor for carrying out this program, rather than a look-up table. Also, the present invention may be applicable to all other fields requiring a data modulation, such as a plasma display panel, an field emission display and an electro-luminescence display, etc.

It will be apparent to those skilled in the art that various modifications and variations can be made in the method and apparatus for driving the liquid crystal display of the present invention without departing from the spirit or scope of the inventions. Thus, it is intended that the present invention covers the modifications and variations of this invention provided they come within the scope of the appended claims and their equivalents.

What is claimed is:

1. A method of driving a liquid crystal display, comprising:

registering a plurality of modulated data in a look-up table;

deriving a modulated data band including one modulated data having a gray scale approximately corresponding to a gray scale value of source data from the plurality of the modulated data and other modulated data adjacent to the one modulated data in horizontal and vertical directions within the look-up table; and carrying out first and second approximations based on the modulated data band to derive an approximate modulated data not registered in the look-up table, thereby modulating the source data using the approximate modulated data.

2. The method according to claim 1, further comprising:

dividing the source data into most significant bits and least significant bits; and delaying each of the most significant bits and the least significant bits for a frame period.

3. The method according to claim 2, further comprising, comparing the most significant bits of a current frame with those of the delayed frame within the look-up table to derive the modulated data band in accordance with the compared result.

4. The method according to claim 1, wherein the carrying out first and second approximations includes:

carrying out the first approximation using current least significant bits along the horizontal direction within the modulated data band to derive two first approximate values existing on the horizontal direction; and carrying out the second approximation using previous least significant bits on a line between the two first approximate values to derive the approximate modulated data.

5. The method according to claim 1, wherein the carrying out first and second approximations includes:

carrying out the first approximation using previous least significant bits along the vertical direction within the modulated data band to derive two first approximate values existing on the vertical direction; and carrying out the second approximation using current least significant bits on a line between the two first approximate values to derive the approximate modulated data.

6. A driving apparatus for driving a liquid crystal display, comprising:

a look-up table having a plurality of registered modulated data and deriving a modulated data band including one modulated data having a gray scale approximately corresponding to a gray scale value of source data and other modulated data adjacent to the one modulated data in horizontal and vertical directions within the look-up table; and a modulator approximating in the horizontal and vertical directions within the modulated data band to derive an approximate modulated data not registered in the look-up table, thereby modulating the source data using the approximate modulated data.

7. The driving apparatus according to claim 6, further comprising:

a first frame memory delaying most significant bits of the source data; and a second frame memory delaying least significant bits of the source data.

8. The driving apparatus according to claim 7, wherein the delayed most significant bits are compared with non-delayed most significant bits within the look-up table to derive the modulated data band in accordance with the compared result.

9. The driving apparatus according to claim 6, wherein the modulator includes:

a first approximation processor carrying out a first approximation using current least significant bits along the horizontal direction within the modulated data band to derive two first approximate values existing on the horizontal direction; and a second approximation processor carrying out a second approximation using previous least significant bits on a line between the two first approximate values to derive the approximate modulated data.

10. The driving apparatus according to claim 6, wherein the modulator includes:

a first approximation processor carrying out a first approximation using previous least significant bits along the vertical direction within the modulated data band to derive two first approximate values existing on the vertical direction; and a second approximation processor carrying out a second approximation using current least significant bits on a line between the two first approximate values to derive the approximate modulated data.

11. The driving apparatus according to claim 6, further comprising:

a data driver applying data modulated by using the modulator to the liquid crystal display;

a gate driver applying a scanning signal to the liquid crystal display; and a timing controller applying the source data to the modulator and controlling the data driver and the gate driver.

12. The driving apparatus according to claim 6, further comprising a single frame memory delaying both most significant bit of the source data and least significant bit of the source data.

13. The driving apparatus according to claim 6, wherein the modulator includes a single approximation processor carrying out a first approximation using current least significant bits along the horizontal direction within the modulated data band to derive two first approximate values existing on the horizontal direction, and a second approximation using previous least significant bits on a line between the two first approximate values to derive the approximate modulated data.

14. The driving apparatus according to claim 6, wherein the modulator includes:

a first approximation processor carrying out a first approximation using previous least significant bits along the vertical direction within the modulated data band to derive two first approximate values existing on the vertical direction; and a second approximation processor carrying out a second approximation using current least significant bits on a line between the two first approximate values to derive the approximate modulated data.

15. A liquid crystal display, comprising:

a liquid crystal display panel displaying images;

a look-up table having a plurality of registered modulated data and deriving a modulated data band including one modulated data having a gray scale approximately corresponding to a gray scale value of source data and other modulated data adjacent to the one modulated data in horizontal and vertical directions within the look-up table; and a modulator approximating in the horizontal and vertical directions within the modulated data band to derive an approximate modulated data not registered in the look-up table, thereby modulating the source data using the approximated modulated data.

* * * * *